United States Patent [19]

Sicking et al.

[11] Patent Number: 4,815,565

[45] Date of Patent: Mar. 28, 1989

[54] LOW MAINTENANCE CRASH CUSHION END TREATMENT

[76] Inventors: Dean L. Sicking, P.O. Box 7077, College Station, Tex. 77843; Hayes E. Ross, Jr., 3700 Old Oaks, Bryan, Tex. 77802

[21] Appl. No.: 941,364

[22] Filed: Dec. 15, 1986

[51] Int. Cl.[4] ..... B60T 3/00; E04H 17/00

[52] U.S. Cl. ..... 188/32; 256/1

[58] Field of Search ..... 188/32, 372; 256/1

[56] References Cited

U.S. PATENT DOCUMENTS

| | | | |
|---|---|---|---|
| 876,170 | 1/1908 | Grant . | |
| 3,416,484 | 12/1968 | Chapman | 116/67 |
| 3,602,109 | 8/1971 | Harrington | 94/1.5 |
| 3,643,924 | 2/1972 | Fitch | 256/13.1 |
| 3,674,115 | 7/1972 | Young et al. | 188/32 X |
| 3,680,662 | 8/1972 | Walker et al. | 188/1 B |
| 3,695,583 | 10/1972 | Walker et al. | 256/1 |
| 3,845,936 | 11/1974 | Roedecker, Jr. et al. | 256/1 |
| 3,944,187 | 3/1976 | Walker | 256/13.1 |
| 3,951,384 | 4/1976 | Hildreth, Jr. | 256/1 |
| 3,982,734 | 9/1976 | Walker | 256/13.1 |
| 4,066,244 | 9/1978 | Yoho | 256/1 |
| 4,198,036 | 4/1980 | O'Neal | 188/32 X |
| 4,407,484 | 10/1983 | Meinzer | 256/13.1 |
| 4,452,431 | 6/1984 | Stephens et al. | 256/13.1 |

FOREIGN PATENT DOCUMENTS

| | | | |
|---|---|---|---|
| 0042645 | 12/1981 | European Pat. Off. | 256/1 |

OTHER PUBLICATIONS

A report entitled "A Low-Maintenance End Treatment for Concrete Barriers", by Dean L. Sicking and Hayes E. Ross, Jr. for presentation at 1986 Annual Meeting of TRB.

*Primary Examiner*—Andres Kashnikow
*Assistant Examiner*—Richard Potosnak
*Attorney, Agent, or Firm*—Arnold, White & Durkee

[57] ABSTRACT

A crash cushion end treatment, comprising a reusable barrier apparatus to protect vehicles traveling along the roadway from fixed roadside obstructions is disclosed. The apparatus is attached to the fixed obstruction and comprises a linear array of deformable cylinders or vented bodies which are designed to attenuate the force of vehicle impact. A single cylindrical member is disposed at the front, or leading edge, of the barrier. The cylindrical member prevents vehicles impacting the barrier "head-on" from being launched over the barrier. Further, a plurality of overlapping fender panels are disposed along each side of the linear array of deformable cylinders. These fender panels are hinged to the barrier so that when the barrier is collapsed, or telescoped inwardly, by an impacting vehicle, the panels may hinge outwardly without being damaged or destroyed. In one preferred embodiment of the present invention, cables are strung through the barrier to keep the barrier substantially in place when a vehicle impacts the barrier either head-on or from the side. A crash cushion barrier incorporating the present invention may be struck repeatedly by vehicles without sustaining serious damage or without being destroyed. A crash cushion barrier according to the present invention may be quickly and easily reset after vehicle impact by pulling and extending the barrier back to its original position, and by making minor alignment adjustments if necessary.

7 Claims, 4 Drawing Sheets

Fig.4
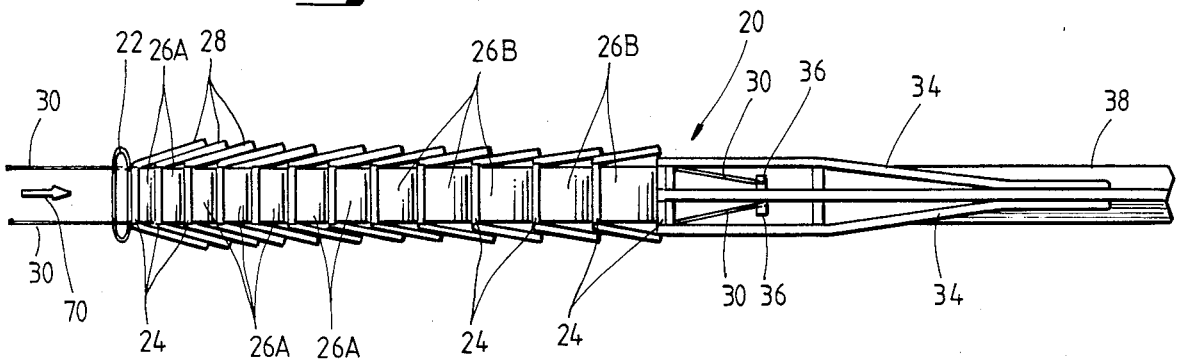
Fig.5
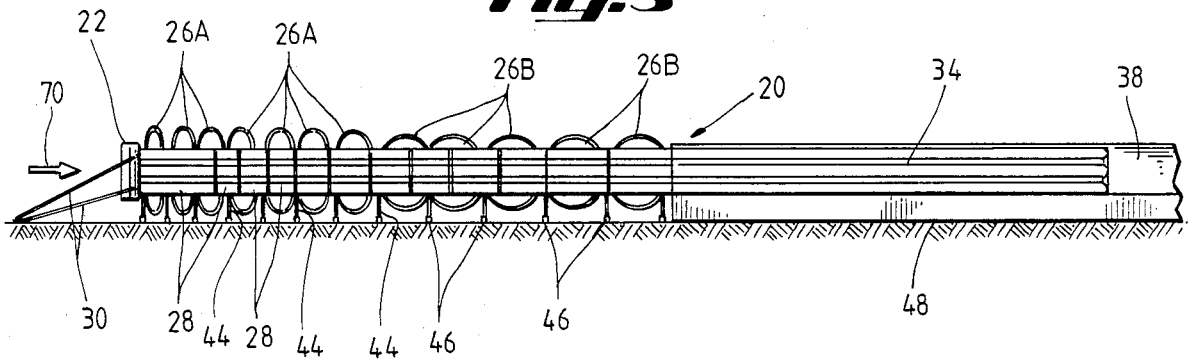
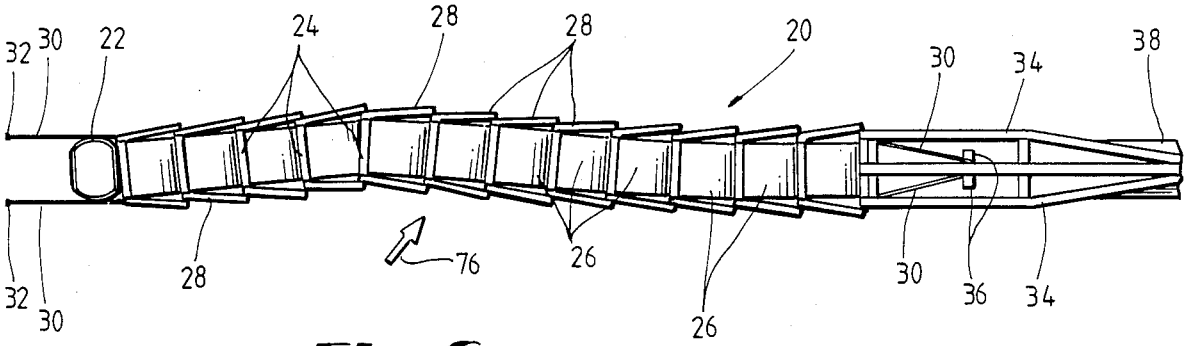
Fig.6

Fig. 9
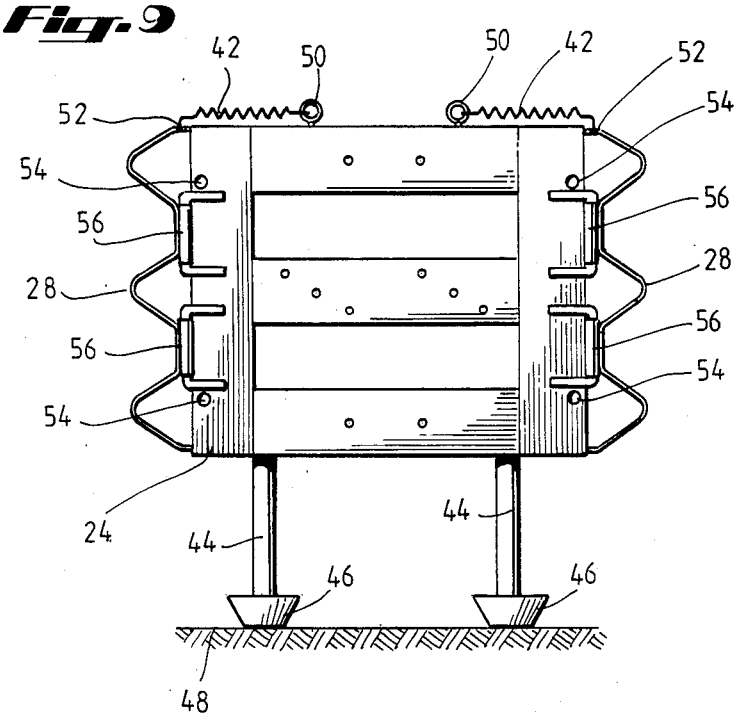
Fig. 10
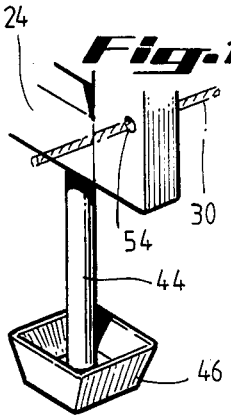
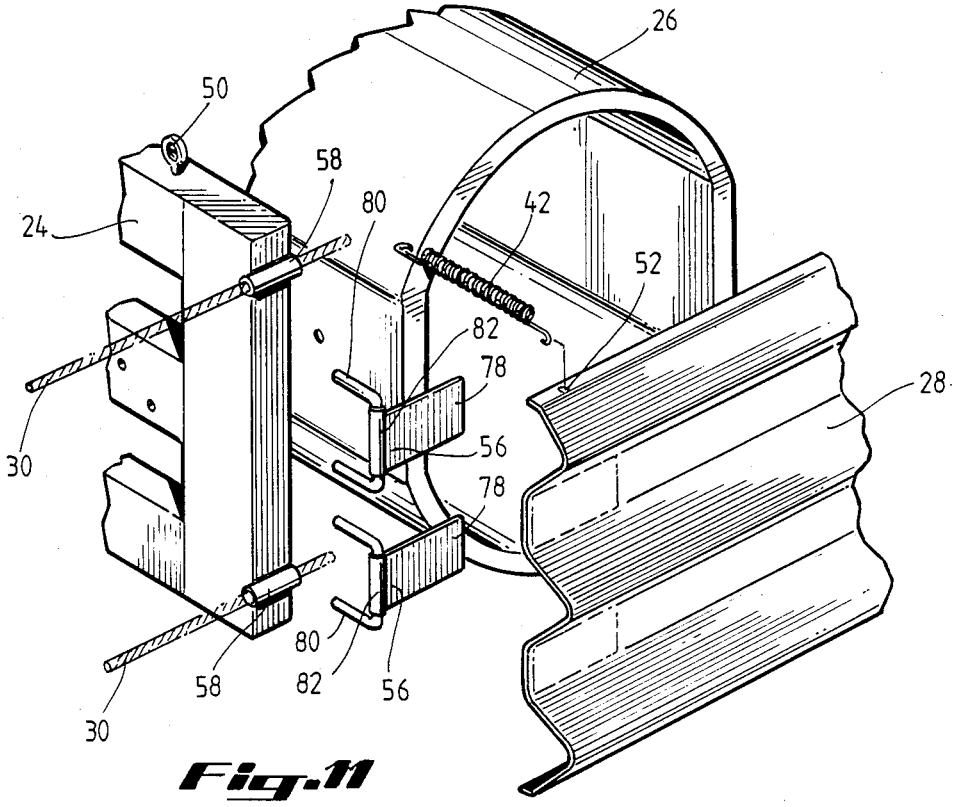
Fig. 11

LOW MAINTENANCE CRASH CUSHION END TREATMENT

BACKGROUND OF THE INVENTION

The present invention relates generally to crash cushion or other similar barrier apparatus used to protect errant vehicles from impacting roadside obstacles. Specifically, the present invention is directed toward an apparatus which is designed to reduce the chances of serious injury to the occupants of a vehicle which impacts a roadside obstruction. The apparatus is also designed to reduce serious damage to the apparatus itself, as well as high repair costs necessary to make the apparatus functional again.

There are two primary functions of a roadside obstacle impact barrier. Initially, and most importantly, the barrier should prevent serious injury to the occupants of the impacting vehicle. Secondarily, the barrier should protect the roadside obstruction itself, which may be a power pole or bridge abutment. Protection of the obstruction is also important, for a downed power pole may mean loss of electrical power for large numbers f people. Similarly, damage to a bridge abutment may cause great expense and inconvenience to tax payers and commuters alike.

The prior art contains several devices which generally perform the above two primary functions of a crash cushion or similar barrier device. However, the barrier devices known in the prior art all suffer from one major drawback, they are "single event" devices. That is, they usually can operate effectively only one time without requiring extensive repair or replacement. Moreover, the repair or replacement of such a barrier has been very expensive, because it is both labor intensive, and material expensive, to continually repair or replace protective roadside barriers. Further, in the intervening days or weeks between the time a barrier has been damaged or destroyed, and the time that it is repaired or replaced, the roadside obstacle is not only exposed to traffic, but it is also unprotected, and is therefore a hazard to highway safety.

The devices of the prior art, therefore, are distinguished by two fundamental drawbacks: they are "single event" protection devices; and they are expensive to repair or replace.

SUMMARY OF THE INVENTION

The present invention deals with the previously unsolved problems of the prior art, by providing a reusable protective roadside barrier that will protect the occupants of a vehicle by absorbing the force of impact before the vehicle reaches the roadside obstruction. The barrier is also able to withstand a number of severe impacts without requiring extensive repair or replacement. Further, the barrier is quickly reusable and involves relatively little expense to repair.

In accordance with the present invention, a number of deformable cylinders are arranged linearly, in an array extending away from the roadside obstruction, in a direction opposite to the flow of traffic.

The cylinders are preferably arranged so that their longitudinal axes are substantially horizontal, and are perpendicular to the centerline of the roadway. The cylinders are positioned so that they are aligned side to side, their axes also being substantially parallel to one another.

A separate rectangular support diaphragm is disposed between each pair of adjacent deformable cylinders. The support diaphragms are designed to hold the cylinders in relation to one another, both before and during vehicle impact. The diaphragms may also support the cylinders a predetermined distance above the roadside. The support diaphragms are fixed to the deformable cylinders by convenient means such as nut and bolt combinations.

A single compressible cylindrical member is disposed at the end, or front, of the single row of deformable cylinders, opposite the roadside obstacle, and nearest to traffic. The cylindrical member is positioned so that the longitudinal axis of the cylindrical member is substantially vertical and is perpendicular to both the centerline of the roadway and the longitudinal axes of the deformable cylinders. The cylindrical member is also attached to a support diaphragm which maintains the member in position relative to the single row of cylinders. The cylindrical member is designed to collapse around the front of a vehicle impacting the barrier "head-on". The cylindrical member is also designed to prevent the vehicle from being launched over the barrier during impact.

A row of overlapping fender panels is attached to each side of the single row of cylinders. The fender panels are arranged in an overlapping "fish-scale" manner so that first side of each panel (nearest the compressible cylindrical member) is overlapped by the second end of each adjacent panel (the end of the panel nearest the roadside obstacle). The first end of each panel is attached to a separate support diaphragm by hinges which allow the panel to pivot outwardly, away from the barrier, as a vehicle impacts the crash cushion barrier, thereby compressing and deforming the cylinders.

Spring means are preferably applied to the second end of each panel to bias the second end of the panel into contact with the overlapped first end of the adjacent panel.

A series of cables are threaded through the support diaphragms so that the crash cushion barrier will act as a single unit during impact, or when redirecting an errant vehicle back onto the roadway.

Finally, connection means are used to connect a crash cushion barrier according to the present invention to the roadside obstruction.

In a preferred embodiment of the present invention, the deformable cylinders and the compressible cylindrical member are made of a compressible, elastomeric material which is able to absorb impact energy at high strain rates and with large deformations, without resultant damage to the material.

In operation, an errant vehicle may impact the crash cushion either "head-on", or at an angle from the side.

The crash cushion barrier attenuates the force of head-on impacts through the controlled collapse of the deformable cylinders. Thus, when impacted "head-on", the crash cushion barrier according to the present invention may be thought of as telescoping inwardly; the force necessary to telescope the barrier equalling the force of impact. When this occurs, the first compressible cylindrical member collapses around the front of the vehicle in order to help prevent the vehicle from being launched over the barrier. The force of impact is then transferred to the support diaphragms, the energy of impact being absorbed by the consecutive collapse of the cylinders. The hinges on the fender panels enable the support diaphragms to be pushed together without damaging the panels themselves.

For most head-on impacts, it has been observed that no component of the present barrier has been seriously damaged, and that the barrier may be quickly reset by pulling the first support diaphragm back to its original position. Minor readjustments in the cushion alignment may then be made if necessary.

Vehicles impacting the side of the barrier are safely redirected by the fender panels, which are held in place laterally by cables threaded throughout the barrier.

BRIEF DESCRIPTION OF THE DRAWINGS

FIG. 4 is a top view of a crash cushion barrier according to the present invention which has been impacted head-on by vehicle.

FIG. 5 is a side elevation view of the crash cushion barrier depicted in FIG. 4.

FIG. 6 is a top view of a crash cushion barrier according to the present invention which has been impacted from the side.

FIG. 9 is a detailed view of a typical interior section of a crash cushion barrier according to the present invention.

FIG. 10 is a detailed view of a leg and skid plate of a typical support diaphragm included in a crash cushion barrier according to the present invention.

FIG. 11 is an exploded, partially cut-a-way, view of a typical front section of a crash cushion barrier according to the present invention.

DETAILED DESCRIPTION OF THE PREFERRED EMBODIMENT

Figure 1:
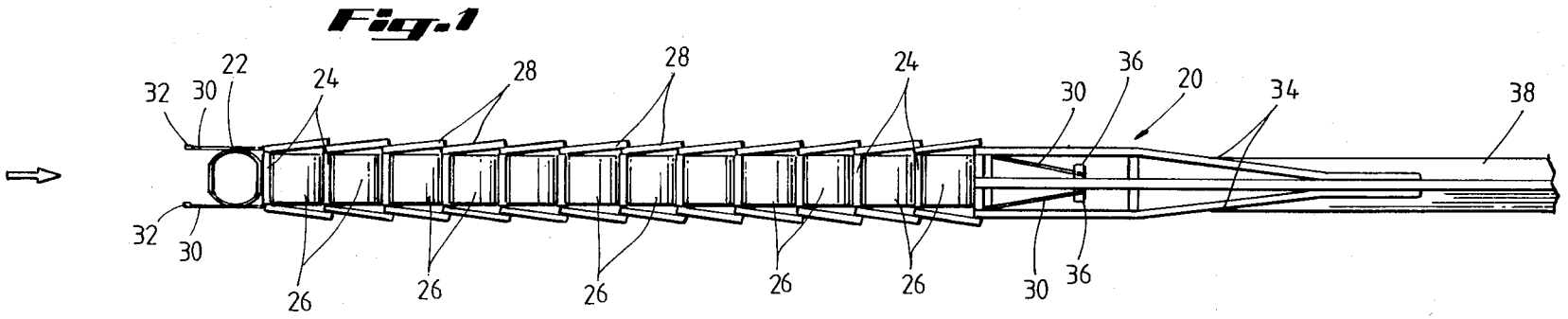
FIG. 1 is a top view of a crash cushion barrier incorporating the present invention.

Referring to FIG. 1, a crash cushion barrier according to the present invention is preferably comprised of a number of different components. A compressible cylindrical member 22 is positioned at the front of the barrier 20. A single row of deformable cylinders 26 is arranged linearly behind the compressible cylindrical member 22, and in front of the roadside obstacle 38 which is to be protected. Each deformable cylinder 26 has a wall thickness which may be defined in terms of the difference between the inner and outer diameters of the cylinder. In one preferred embodiment of the present invention, the wall thicknesses of the cylinders 26 may be varied so that no cylinder 26 located near compressible cylindrical member 22 has a wall thickness which is greater than the wall thickness of a cylinder 26 located near the obstacle 38. In yet another embodiment of the present invention, the wall thicknesses of the deformable cylinders 26 increase from compressible cylindrical member 22 to obstacle 38. The number of deformable cylinders 26 will be a function of parameters such as the posted roadway speed and the wall thicknesses of the deformable cylinders 26.

A separate support diaphragm 24 is disposed between compressible cylindrical member 22 and the first deformable cylinder 26, and between each pair of adjacent individual deformable cylinders 26.

Figure 2:
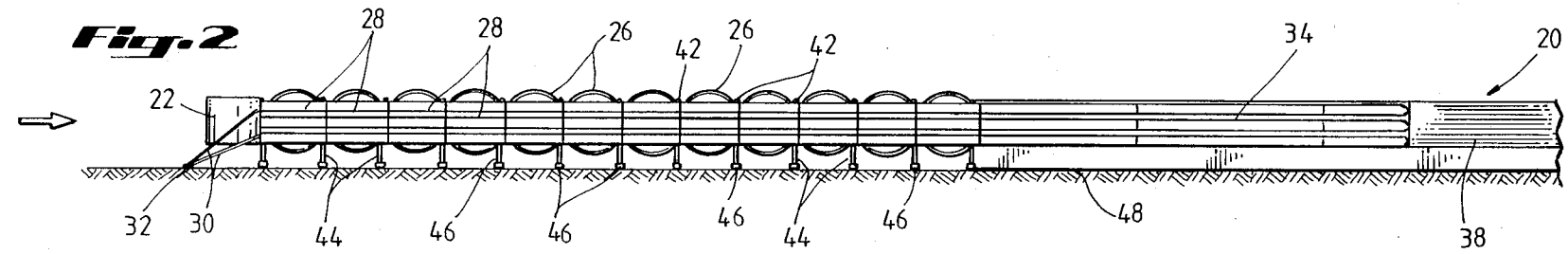
FIG. 2 is a side elevation view of the crash cushion barrier depicted in FIG. 1.

Referring now to FIGS. 1 and 2, it may be seen that the support diaphragms 24 maintain the deformable cylinders 26 in position relative to one another. In accordance with the present invention, each deformable cylinder 26 is attached to two support diaphragms 24. Referring specifically to FIG. 2, each support diaphragm 24 is provided with one or more legs 44 which raise the support diaphragm a predetermined distance above the roadside 48. This in turn also serves to keep the deformable cylinders 26 a predetermined distance above the roadside 48. Each leg 44 is in turn provided with a skid plate 46 which enables the leg 44 and its support diaphragm 24 to be displaced or slid along the roadside 48.

Still referring to FIGS. 1 and 2, a crash cushion barrier in accordance with the present invention is provided with an array of fender panels, on guard rail section 28 extending along each side of the single row of deformable cylinders 26. Fender panels 28 are arranged in an overlapping "fish-scale" manner, so that the front end, nearest compressible cylinder member 22, of a typical panel 28 is overlapped by the back end, located nearest obstacle 38, of the preceding panel 28.

In a preferred embodiment of the present invention, elongated panels 34 are attached to the roadside obstacle 38 and the last support diaphragm 24 in order to tie the overall crash cushion barrier to the obstacle. In yet another embodiment of the present invention, a pair of cables 30 are threaded through each support diaphragm 24 along each side of the crash cushion barrier 20. Each pair of cables 30 may be anchored at a point 32 just in front of the compressible cylindrical member 22 at one end, and at a point 36 attached to roadside obstacle 38. Cables 30 serve to keep a crash cushion barrier according to the present invention aligned both before and during vehicle impact. Further, as will be discussed later, cables 30 also restrain lateral movement of the barrier when a vehicle impacts the barrier from the side.

Figure 3:
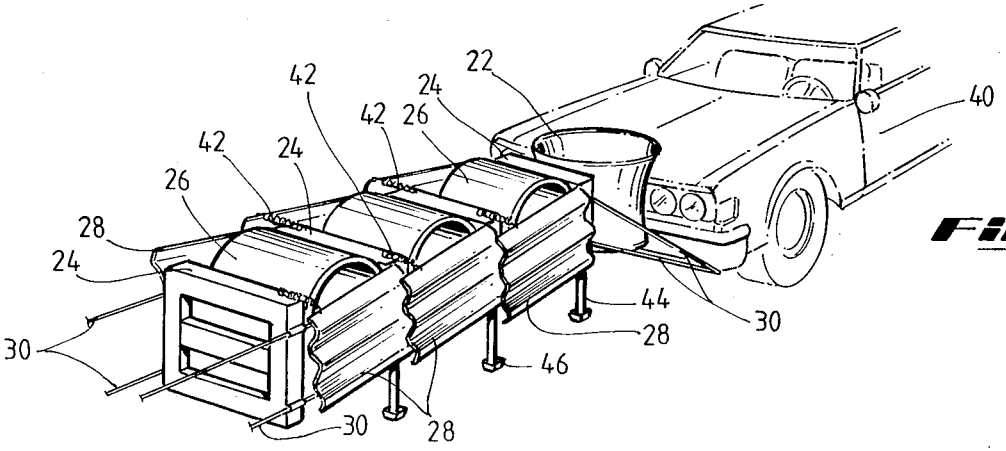
FIG. 3 is an overall perspective view with a front section of a crash cushion barrier according to the present invention being impacted "head-on" by an errant vehicle.

Referring to FIG. 3, the front section of a crash cushion barrier 20 according to the present invention is shown being impacted "head-on" by a vehicle 40. As vehicle 40 impacts the barrier 20 head-on, the vehicle 40 will first encounter compressible cylindrical member 22 which is preferably open-ended. Cylindrical member 22 is designed so that as the vehicle 40 impacts the cylindrical member 22, member 22 will deform around the front end of vehicle 40. Cylindrical member 22 will thereby engage the front end of vehicle 40 so that vehicle 40 will not be launched over the barrier 20, but rather will be directed along the barrier.

Referring to FIG. 4, a crash cushion barrier 20 according to the present invention is shown after a vehicle has impacted the barrier 20 in the direction indicated by arrow 70. In accordance with the present invention, cylindrical member 22 has deformed so as to engage the front end of the vehicle to restrain the vehicle from being launched over the barrier 20. Several individual deformable cylinders 26A, located closest to the front end of the barrier 20, are deformed or compressed by the impact force of the vehicle. The successive compressing of the deformable cylinders 26A is designed to attenuate the force of vehicle impact and to bring the vehicle safely to rest before the vehicle encounters roadside obstacle 38. In order to help prevent extensive damage to either the vehicle or the barrier, the fender panels 28 are attached to the support diaphragms 24 by hinges so that as deformable cylinders 26A are compressed, the fender panels 28 hinge outwardly and collapse successively one upon another. Expressed otherwise, a crash cushion barrier 20 embodying the present invention will telescope inwardly toward the fixed obstruction 38, when a vehicle impacts the barrier 20 head-on. Cables 30 threaded through the barrier 20 and attached to the fixed obstruction 38 serve to restrain the barrier 20 from being laterally displaced during vehicle impact.

Referring specifically to FIG. 5, as a vehicle impacts the barrier 20 along the direction indicated by arrow 70, and as deformable cylinders 26A are compressed and deformed, the support diaphragms 24, resting upon legs 44, will be displaced toward the fixed obstruction 38. Skid plates, or shoes 46, attached to the bottom of each leg 44, allow the support diaphragms 24 to slide along the roadside 48. In one preferred embodiment, deformable cylinders 26A and 26B are open-ended. In yet another embodiment, deformable cylinders 26 are vented bodies able to allow air to escape the body of the cylinders when the cylinders are deformed.

Referring to FIGS. 4 and 5, when a light weight vehicle traveling at posted speeds impacts the barrier 20 substantially head-on, as indicated by arrow 70, generally only the front cylinders 26A to bring the vehicle safely to rest. If, however, a larger vehicle, traveling at a higher speed, impacts the barrier in the direction indicated by arrow 70, additional posteriorly placed deformable cylinders 26B are provided, and may be compressed in the same manner discussed above in order to bring the vehicle safely to rest.

In one preferred embodiment of the present invention, the wall thickness of each deformable cylinder 26A will be less than the wall thickness of each deformable cylinder 26B. The wall thicknesses of the deformable cylinders 26A and 26B may be defined in terms of the difference between the inner and the outer diameter of the cylinders. In yet another embodiment of the present invention, the wall thickness of any given deformable cylinder 26A or 26B located closer to compressible cylindrical member 22, will be less than or equal to the wall thickness of a deformable cylinder 26A or 26B located closer to roadside obstacle 38.

Referring to FIG. 6, a crash cushion barrier 20 embodying the present invention is depicted after it has been impacted from the side, as indicated by arrow 76. In this instance, cables 30 anchored to the roadside at 32 at the front of the barrier 20, and anchored to the fixed obstacle 38 by anchors 36 at the back of the barrier 20, restrain the barrier 20 substantially in place and help prevent great lateral displacement of the barrier. In this manner, a crash cushion barrier 20 according to the present invention provides substantially the same lateral protection as a barrier according to the prior art. However, a barrier 20 embodying the present invention will not generally damage a vehicle that laterally impacts the barrier in a direction indicated by arrow 76 as much as a barrier according to the prior art, because the barrier according to the present invention will normally have more "give" to it, and may be somewhat laterally displaced. Further, a barrier incorporating the present invention will normally not be as severely damaged by a side impact as will the barriers of the prior art.

Referring to FIGS. 4, 5, and 6, after a vehicle has impacted, and deformed the barrier 20 by telescoping it inwardly, or displacing it laterally, the barrier 20 may be quickly reset in order to protect other vehicles from roadside obstacle 38 without undue delay or expense. For most head-on and side impacts, no components of the barrier 20 will normally be damaged, and the barrier 20 may be restored to its original position by simply pulling the first support diaphragm 24 to its original position, and making possible minor readjustments to the alignment of the barrier.

Figure 7:
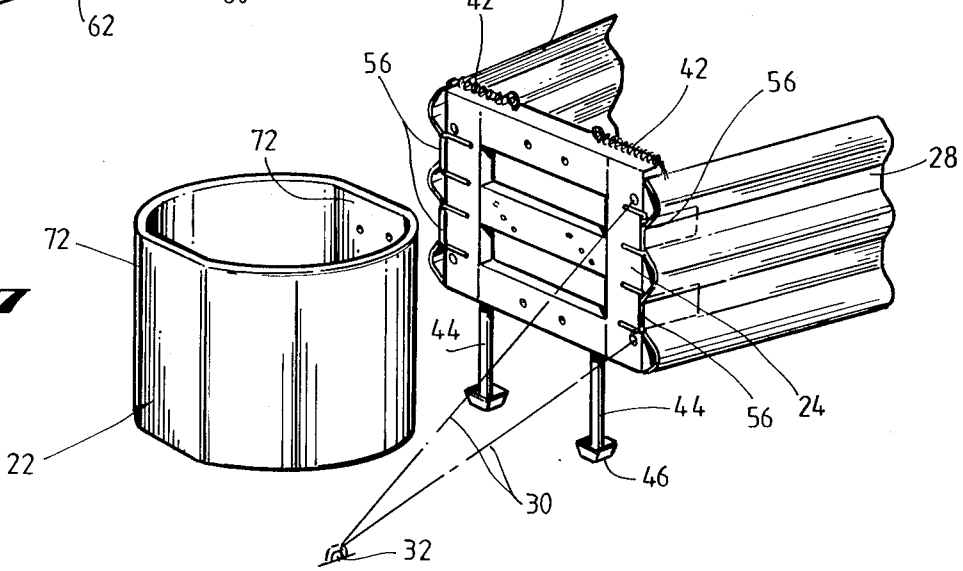
FIG. 7 is an exploded view of the front section of a crash cushion barrier according to the present invention.

Referring to FIG. 7, an exploded view of the front section of a barrier incorporating the present invention is shown. As shown, the compressible cylindrical member 22 may be formed from an elastomeric material and may typically have a wall thickness varying from about 1.5 inches to 4.5 inches, depending upon the type of traffic and posted traffic speed. Cylindrical member 22 may be attached to a first support diaphragm 24 by nut and bolt combinations. In a preferred embodiment of the present invention, cylindrical member 22 may be provided with two substantially flat opposed surfaces 72. Surfaces 72 provide both mounting and contact surfaces on compressible cylindrical member 22.

Each support diaphragm 24 is typically provided with a pair of legs 44 which elevate support diaphragm 24 a predetermined distance above the surface of the roadside. In a preferred embodiment, as shown in FIGS. 3, 7, and 11, the support diaphragm 24 will be constructed of structural steel box tubing. Each leg 44 is provided with a separate skid plate or shoe 46 to allow the support diaphragm 24 to be displaced along the roadside during vehicle impact.

A separate fender panel 28, or guard rail section is attached to each side of each support diaphragm 24 by a pair of hinges 56. In one embodiment of the present invention, the hinges may be formed from $\frac{3}{4}$ inch steel rod, a section of iron pipe having a $\frac{3}{4}$ inch inner diameter, and $\frac{1}{4}$ inch steel plate. Each fender panel 28 is attached to its support diaphragm 24 by hinges 56 so that the panel may be allowed to hinge or pivot outwardly, away from the longitudinal axis of the barrier, during impact. A pair of opposed springs 42 may be provided to urge the fender panels 28 into substantially close relation to an overlapped adjacent panel 28 during normal operation.

Figure 8:
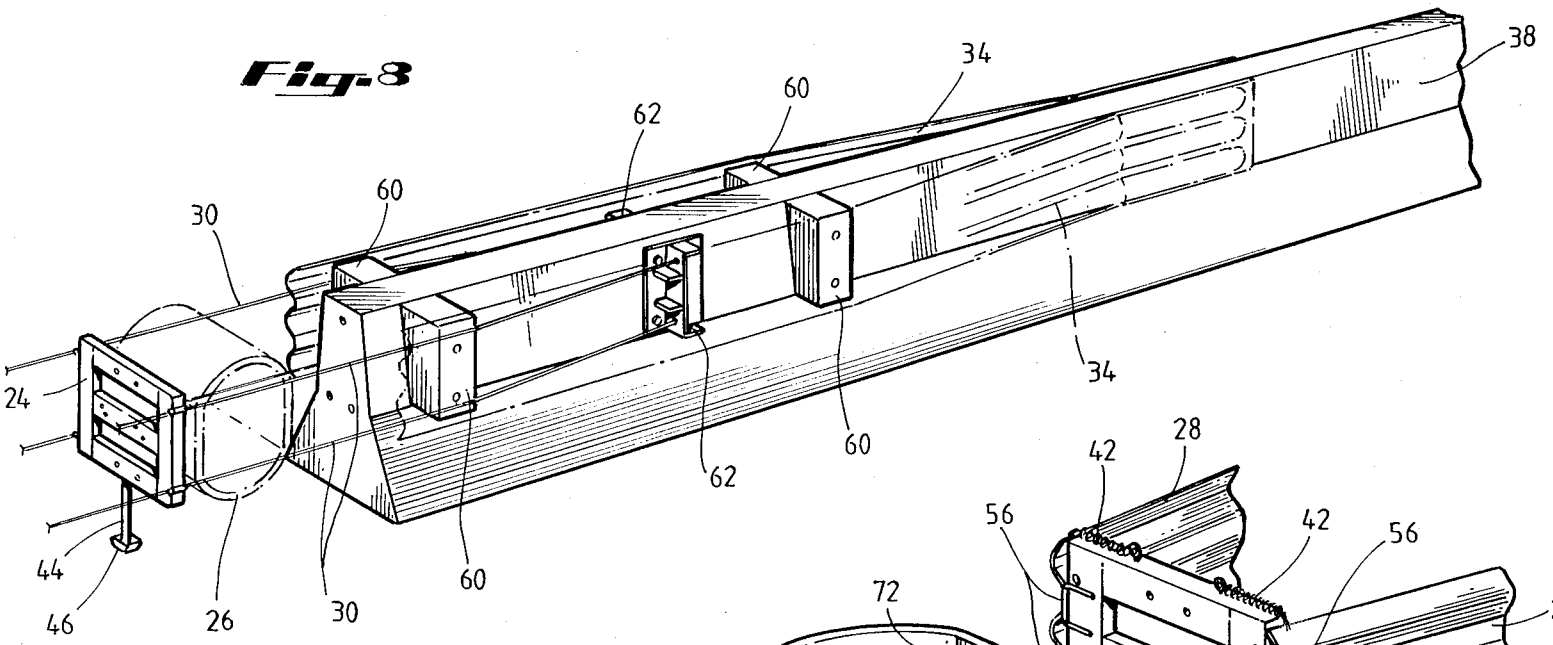
FIG. 8 is a detailed view of the back of a crushed cushion barrier according to the present invention.

Referring to FIG. 8, an exploded view of the back end of a barrier incorporating the present invention is shown. In a preferred embodiment of the invention, a final support diaphragm 24 is disposed between, and attached to, the last two deformable cylinders 26. The very last deformable cylinder 26 is also attached to fixed roadside obstruction 38. In yet another embodiment of the present invention, the last support diaphragm 24 may be provided with only one leg 44.

Cables 30 which are threaded through each support diaphragm 24 are attached to the roadside obstruction 38 by means of anchors 62. A separate anchor 62 is preferably provided for each pair of cables which are threaded through each side of the barrier. An elongated fender panel section 34 may be typically attached to each side of the fixed obstruction 38 to provide a continuous impact surface from the crash cushion barrier to the obstruction 38.

In still another embodiment of the present invention, panel mounts 60 may be attached to the fixed obstruction 38 to position the elongated panel sections 34 in spaced relation to the obstruction 38.

Referring to FIG. 9, a typical interior section of a crash cushion barrier incorporating the present invention is shown. The support diaphragm 24 is provided with two legs 44 which elevate the support diaphragm 24 a predetermined distance above the surface of the roadside 48. Each leg 44 is provided with a separate skid plate or shoe 46 which allows the support diaphragm 24 to slide along the roadside 48. A separate fender panel 28 is attached to each side of each support diaphragm 24 by a pair of hinges 56. The hinges 56 attach the end of the fender panel 28 which is nearest the front of the barrier to the support diaphragm 24. The hinges 56 on the fender panels 28 allow the support diaphragms 24 to be pushed together during vehicle impact without damaging the panels 28 themselves. Steel springs 42 located on the top of the support diaphragm 24 restrain movement of the fender panel 28 under normal conditions. In a preferred embodiment, each spring 42 is attached to the support diaphragm 24 by an eyelet 50 at one end, and to the back end of an overlapping fender panel 28 through a hole 52 in the panel at the other end of the spring 42. Springs 42, under normal conditions, are slightly extended so that each spring 42 will urge the second overlapping end of a fender panel 28 into contact with the first hinged end of an overlapped fender panel 28 which is attached to the same support diaphragm 24 as springs 42.

Each support diaphragm 24 is also provided with a plurality of holes 54 formed along the outer edges of the support diaphragm 24.

Referring to FIGS. 9 and 10, the arrangement of cables 30 threaded through holes 54 in a support diaphragm 24 is more clearly shown. Further, details of one leg 44 and skid plate or shoe 46 attached thereto are more fully disclosed.

Finally, referring to FIG. 11, there is shown, in combination, an exploded view of a first support diaphragm 24 and deformable cylinder 26. As may be seen in FIG. 11, a fender panel 28 is attached to the side of a support diaphragm 24 by a pair of hinges 56. In one embodiment of the present invention, each hinge 56 may be comprised of a steel plate 78, a section of steel pipe 82 and a bent section of steel rod 80. In this embodiment, the steel plate 78 is attached to a flat section of fender panel 28, as by means of a welded connection or a nut and bolt combination. Steel rod 80 is then attached to support diaphragm 24, again as by means of a welded connection.

In one preferred embodiment of the present invention, the deformable cylinder 26 is bolted to the leading support diaphragm 24 as shown in FIG. 11. FIG. 11 depicts the first support diaphragm 24 located at the front of the overall crash cushion barrier. In another preferred embodiment of the present invention, cables 30, used to keep the crash cushion barrier aligned both before and during impact, are threaded through a pair of tubes 58 which are welded to the side of the first support diaphragm 24. In the remaining support diaphragms, the cables 30 are threaded through holes 54, as seen in FIG. 9. Tubes 58, welded to the side of the first support diaphragm 24, are used to guide cables 30 as they exit the front of the barrier in order to be anchored to the roadside.

Referring still to FIG. 11, a spring 42 attached at one end to an eyelet 50 on support diaphragm 24, and attached at its other end to fender panel 28 through a hole 52, is used to bias the first fender panel 28 on each side of the barrier into overlapping contact with the second fender panel 28.

Various modifications and improvements may be made to the disclosed embodiments without departing from the overall scope and spirit of the invention. For example, the wall thicknesses of the deformable cylinders and the compressible cylindrical member may be varied.

Having therefore fully and completely disclosed the best modes of my invention, I now claim:

1. A crash cushion apparatus to protect vehicles from impacting a fixed roadside construction, comprising:

a compressible cylindrical member, said cylindrical member having a longitudinal axis, said cylindrical member being positioned so that said longitudinal axis is substantially vertical and perpendicular to the plane of said roadway;

a plurality of deformable cylinders, each said cylinder having a longitudinal axis, said plurality of deformable cylinders being arranged in a single row, one cylinder wide, linearly away from said compressible cylindrical member, such that the longitudinal axis of each said cylinder is substantially horizontal and perpendicular to flow or traffic on said roadway and perpendicular to said longitudinal axis of said compressible cylindrical member;

a plurality of support diaphragms, a single said diaphragm being positioned between each pair of adjacent said deformable cylinders, and between said compressible cylindrical member and its adjacent said deformable cylinder, and adapted to hold said cylinders and said cylindrical member in relation to one another;

a plurality of fender panels arranged in overlapping fish-scale relation so as to cover opposed ends of said linearly arranged cylinders, each said panel having a first end, facing toward said cylindrical member, and a second end, facing toward said obstruction; the first end of each said panel being hinged to a separate support diaphragm, the second end of each said panel overlapping the first end of an adjacent panel;

spring means to bias each said overlapping second end of each said fender panel into close relation with the first end of an adjacent fender panel; and cables interconnecting said support diaphragms.

2. The apparatus according to claim 1, wherein said compressible cylindrical member and said plurality of deformable cylinders are made of an elastomeric material capable of absorbing impact energy at high strain rates and with large deformations.

3. The apparatus according to claim 1, wherein said compressible cylindrical member and said plurality of deformable cylinders are adapted to be supported a predetermined distance above said roadside.

4. The apparatus according to claim 1, wherein said support diaphragms are made of structural steel box tubing.

5. The apparatus according to claim 1, wherein said deformable cylinders are positioned side to side so that their longitudinal axes are parallel.

6. The apparatus according to claim 1, wherein each said fender panel is a guardrail section.

7. A crash cushion apparatus to protect vehicles from impacting a fixed roadside obstruction, comprising:

a compressible cylindrical member, said cylindrical member having a longitudinal axis, said cylindrical member being positioned so that said longitudinal axis is substantially vertical and perpendicular to the plane of said roadway;

a plurality of deformable cylinders, each said cylinder having a longitudinal axis, said plurality of deformable cylinders being arranged linearly, away from said compressible cylindrical member, such that the longitudinal axis of each said cylinder is substantially horizontal and perpendicular to said roadway;

a plurality of support diaphragms, a single said diaphragm being positioned between each pair of adjacent deformable cylinders, and between said compressible cylindrical member and its adjacent said deformable cylinder, said support diaphragms being adapted to hold said cylinders and said cylindrical member and its adjacent cylinder in relation to one another;

a plurality of fender panels arranged in overlapping fish-scale relation so as to cover opposed sides of said linearly arranged cylinders, each said panel having a first end, facing toward said cylindrical member, and a second end, facing towards said obstruction;

the first said end of each said panel being hinged to a separate support diaphragm, while the second said end of each said panel overlaps the first end of an adjacent panel;

spring means to bias each said overlapping second end of each said fender panel into close relation with the first end of an adjacent fender panel;

cables interconnecting said support diaphragms; and each said deformable cylinder having a wall thickness, measured as the distance between the inner diameter and the outer diameter of each said cylinder, wherein the wall thickness of cylinders increases from said compressible cylindrical member to said roadside obstruction.

* * * * *